US006537028B1

(12) United States Patent
Izumi et al.

(10) Patent No.: US 6,537,028 B1
(45) Date of Patent: Mar. 25, 2003

(54) DIFFUSER ARRANGEMENT FOR CENTRIFUGAL COMPRESSORS

(75) Inventors: Masahiko Izumi, Wako (JP); Eiichi Hirose, Tokyo (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/962,791

(22) Filed: Sep. 26, 2001

(30) Foreign Application Priority Data

Sep. 26, 2000 (JP) ..... 2000-292017

(51) Int. Cl.[7] ..... F04D 29/44
(52) U.S. Cl. ..... 415/208.3; 415/224.5
(58) Field of Search ..... 415/207, 208.2, 415/208.3, 224.5

(56) References Cited

U.S. PATENT DOCUMENTS 3,941,501 A * 3/1976 Shank ..... 415/224.5
3,964,837 A * 6/1976 Exley ..... 415/208.3
4,302,150 A 11/1981 Wieland
5,145,317 A 9/1992 Brasz

* cited by examiner

*Primary Examiner*—Christopher Verdier
(74) *Attorney, Agent, or Firm*—Arent Fox Kintner Plotkin & Kahn

(57) ABSTRACT

In a diffuser arrangement for centrifugal compressors, a longitudinal center line of each passage is tangential to a reference tangent circle defined concentrically with respect to the impeller and having a smaller diameter than an outer diameter of the impeller so that a leading edge defined at an intersection between each pair of adjacent passages is brought close to an outer periphery of the impeller. Because the leading edge, in particular the side portions thereof, is brought close to the outer peripheral part of the impeller, the incidence mismatch can be minimized so that a blockage in the throat section of each passage can be avoided, and the static pressure can be recovered at a high efficiency. Also, when drilling the passages, protrusions are not formed in the inner peripheral part of the diffuser. Elimination of the need to remove such protrusions contributes to the reduction in the manufacturing cost.

5 Claims, 7 Drawing Sheets

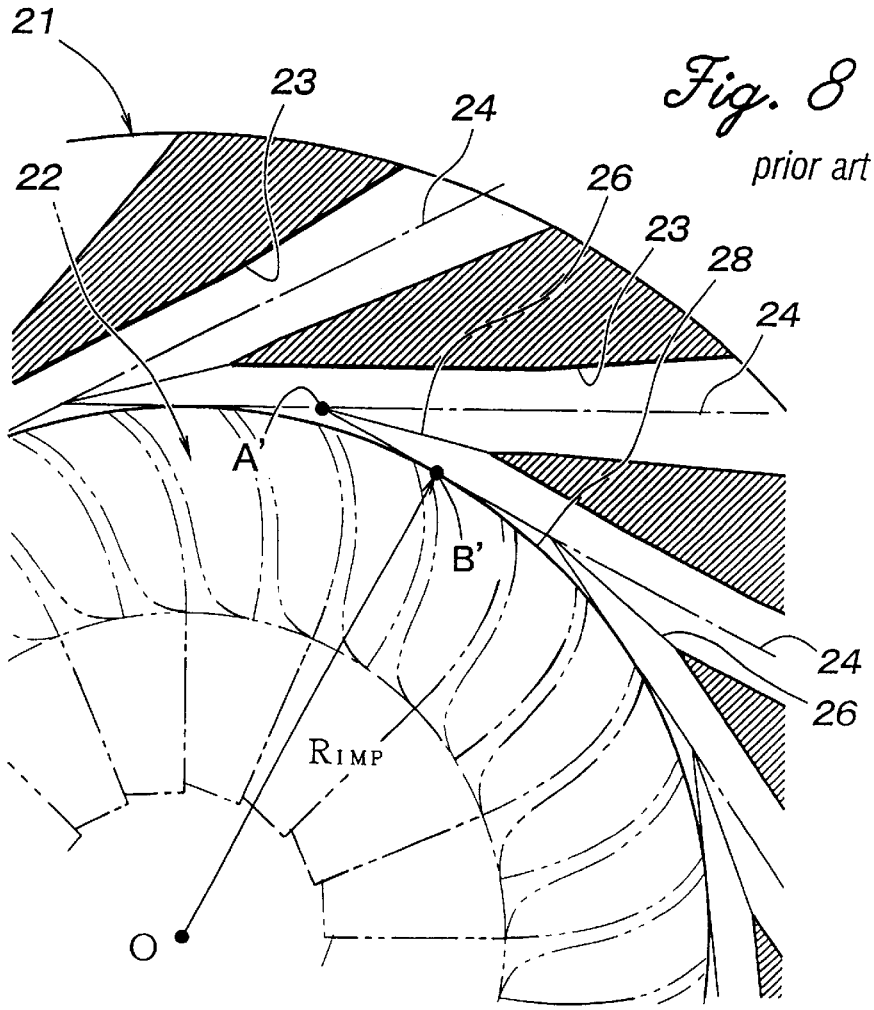
Fig. 8
prior art
Fig. 9
prior art
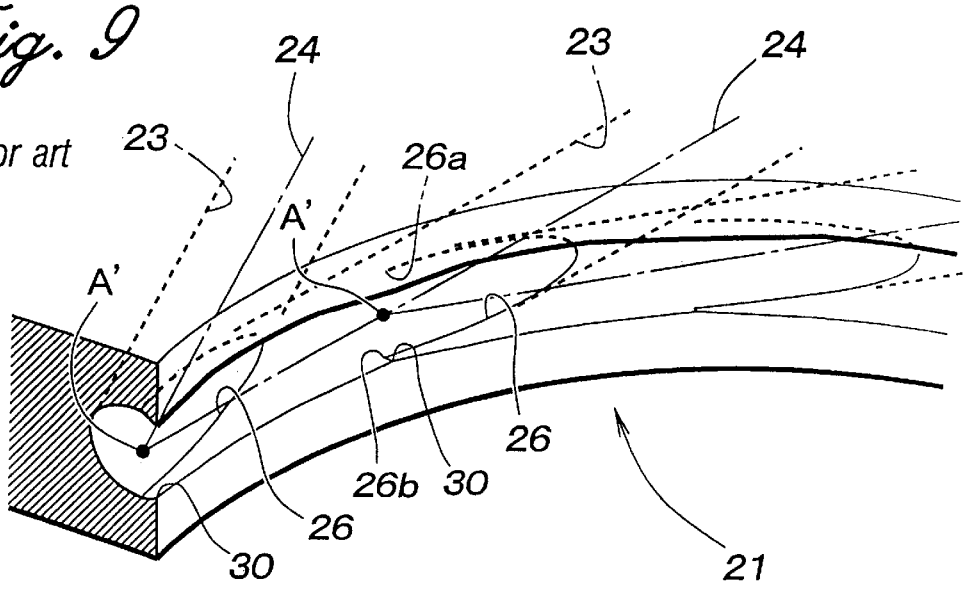

DIFFUSER ARRANGEMENT FOR CENTRIFUGAL COMPRESSORS

TECHNICAL FIELD

The present invention relates to a diffuser that surrounds an impeller of a centrifugal compressor, and in particular to a diffuser arrangement including a plurality of tangential passages formed in an annular member surrounding the impeller circumferentially at a regular interval for converting the velocity of the fluid exiting the impeller into the pressure thereof.

BACKGROUND OF THE INVENTION

A centrifugal compressor is provided with a diffuser disposed around the impeller for decelerating the fluid flow from the impeller and converting the dynamic pressure of the fluid flow into a static pressure. A diffuser normally defines a plurality of passages which extend across a circumferential circle defined around the impeller. Such passages are most commonly defined by stator vanes that extend between a pair of walls. Another form of diffusers is called as "a pipe diffuser" which consists of a plurality of passages each having a circular cross section. Such a diffuser may be formed by drilling passages in an annular member, and a diffuser of this type is disclosed in U.S. Pat. No. 5,145,317.

In such a pipe diffuser, as shown in FIGS. 8 and 9, an arcuate leading edge 26 is formed between each adjacent pair of passages 23 which intersect each other at an acute angle at point A' (as seen on the projected plane in parallel with the paper of FIG. 8). According to such a conventional diffuser, the passages 23 are formed in such a manner that the longitudinal center line 24 of each passage 23 tangentially touches the outer peripheral circle 28 of the impeller 22 at point B'. Therefore, the longitudinal center line 24 is at a right angle to the radial line OB' of the impeller 22. However, the front parts 26*a* and 26*b* of the leading edge 26 which coincide with point A' in FIG. 8 are spaced away from the outer peripheral circle 28 of the impeller 22 by a certain distance, and this distance increases as the number of passages decreases. Therefore, in a diffuser arrangement using a small number of passages, this distance creates an incidence mismatch which could cause a blockage of a throat section of each passage 23, and impair the efficiency in recovering static pressure.

Also, when drilling the passages, protrusions 30 tend to remain between the front ends or side ends 26*a* and 26*b* of leading edge 26 and the inner peripheral part of the diffuser, and the need for removing such protrusions 30 increases the manufacturing cost.

BRIEF SUMMARY OF THE INVENTION

In view of such problems of the prior art, a primary object of the present invention is to provide a diffuser arrangement for centrifugal compressors which can substantially reduce the incidence mismatch, and can thereby improve the efficiency in recovering the static pressure.

A second object of the present invention is to provide a diffuser arrangement for centrifugal compressors which provides a high efficiency even when the number of passages is relatively small.

A third object of the present invention is to provide a diffuser arrangement for centrifugal compressors which allows the machining work to be simplified.

According to the present invention, such objects can be accomplished by providing a diffuser arrangement for a centrifugal compressor, comprising a member surrounding an impeller of the compressor and defining a plurality of passages extending substantially tangentially around the impeller at a regular interval circumferentially, wherein: a longitudinal center line of each of the passages is tangential to a reference tangent circle defined concentrically with respect to the impeller and having a smaller diameter than an outer diameter of the impeller so that a leading edge defined at an intersection between each pair of adjacent passages is brought close to an outer periphery of the impeller.

Because the leading edge, in particular the side portions thereof, is brought close to the outer peripheral part of the impeller, the incidence mismatch can be minimized so that a blockage in the throat section of each passage can be avoided, and the static pressure can be recovered at a high efficiency. Also, when drilling the passages, protrusions are not formed in the inner peripheral part of the diffuser. Elimination of the need to remove such protrusions contributes to the reduction in the manufacturing cost.

Preferably, the radius of the reference tangent circle or $R_{tan}$ is given by $R_{tan}=R_{IMP}\times\cos(\pi/N)+\delta$ where $R_{IMP}$ is the radius of the impeller, N is the number of passages, and $\delta$ is a small gap for providing a clearance between the impeller and diffuser.

Preferably, the number of passages is between 10 and 22. If the number is less than 10, the wavy shape in the inlet part of the diffuser becomes so pronounced that a substantial mismatch is created between the impeller outlet and the diffuser inlet. If the number is greater than 22, the radius of the reference tangent circle would differ from that of the outer periphery of the impeller by no more than 1%, and the resulting gain would not be appreciable.

The diffuser of the present invention can be fabricated easily but still can demonstrate a high efficiency. According to such an embodiment, the passages may consist of holes drilled in an annular member disposed concentrically with respect to the impeller. Each of the passages may be slightly flared outwardly at least in a radially outer part thereof. Alternatively, each of the passages may be provided with a rectangular or other polygonal cross section or elliptic cross section without departing from the spirit of the present invention. In such a case, the diffuser may be also formed by casting, forging, machining or other metal working processes.

BRIEF DESCRIPTION OF THE DRAWINGS

Now the present invention is described in the following with reference to the appended drawings, in which:

FIG. 8 is a view similar to FIG. 3 showing a conventional diffuser; and

FIG. 9 is a view similar to FIG. 4 showing the conventional diffuser.

DETAILED DESCRIPTION OF THE PREFERRED EMBODIMENTS

Figure 1:
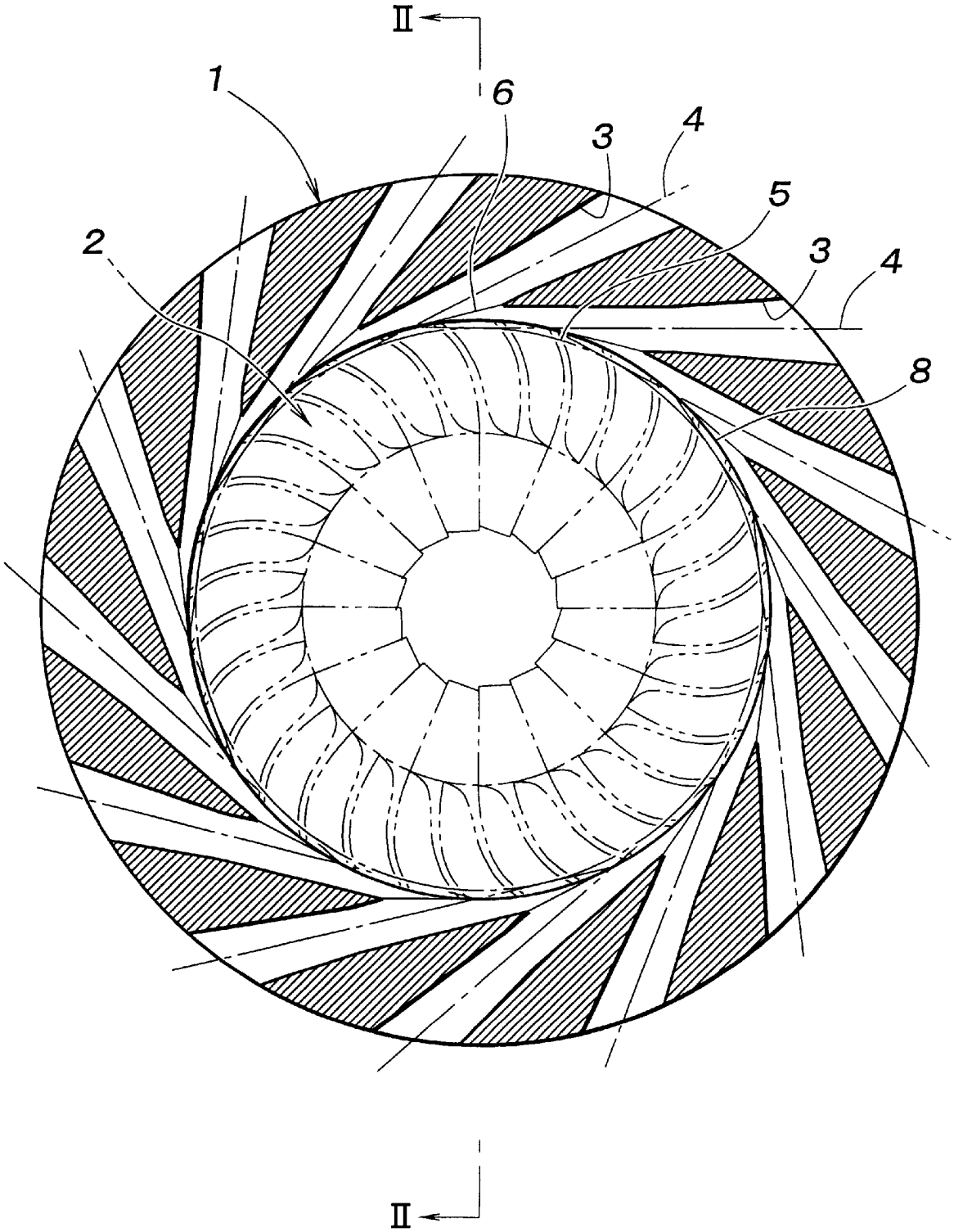
FIG. 1 is a sectional front view of a diffuser for a centrifugal compressor embodying the present invention.
Figure 2:
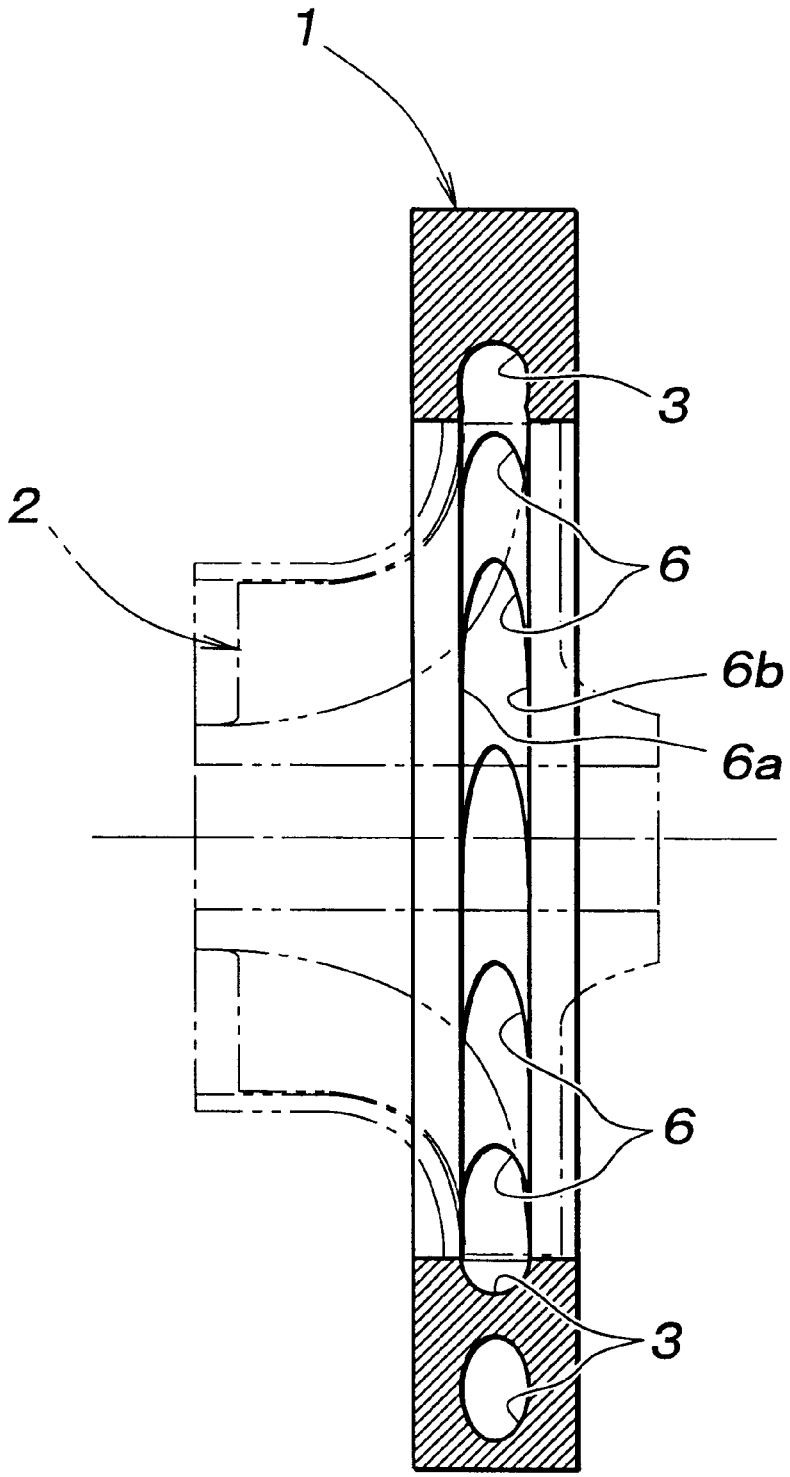
FIG. 2 is a sectional side view of the diffuser taken along line II—II of Figure

FIGS. 1 and 2 show a diffuser 1 for a centrifugal compressor embodying the present invention. The diffuser 1 is formed by forming passages 3 in an annular disk member disposed concentrically around the impeller 2 of the centrifugal compressor, and the passages 3 extend radially outwardly each along a substantially tangential direction between the inner circumference and outer circumference of the annular disk member. These passages 3 are arranged at a regular interval along the circumference, and are each provided with a substantially circular cross section. Each passage 3 is provided with a longitudinal center line 4 which extends tangentially with respect to a reference tangent circle 5 defined coaxially with respect to the impeller 2 as will be described hereinafter.

Each passage 3 is flared toward the outer circumference at a prescribed flare angle, and the longitudinal center line 4 thereof consists of a straight line so that it can be formed by drilling or other machining process. The part of each passage toward the inner peripheral part of the annular disk member may consist of a straight cylindrical hole while the remaining part of the passage flares toward the outer circumference. The leading edge 6 that is defined between each pair of adjacent passages 3 is linear as seen from the front (see FIG. 1) but presents an arcuate shape as seen from a side (see FIG. 2).

Figure 3:
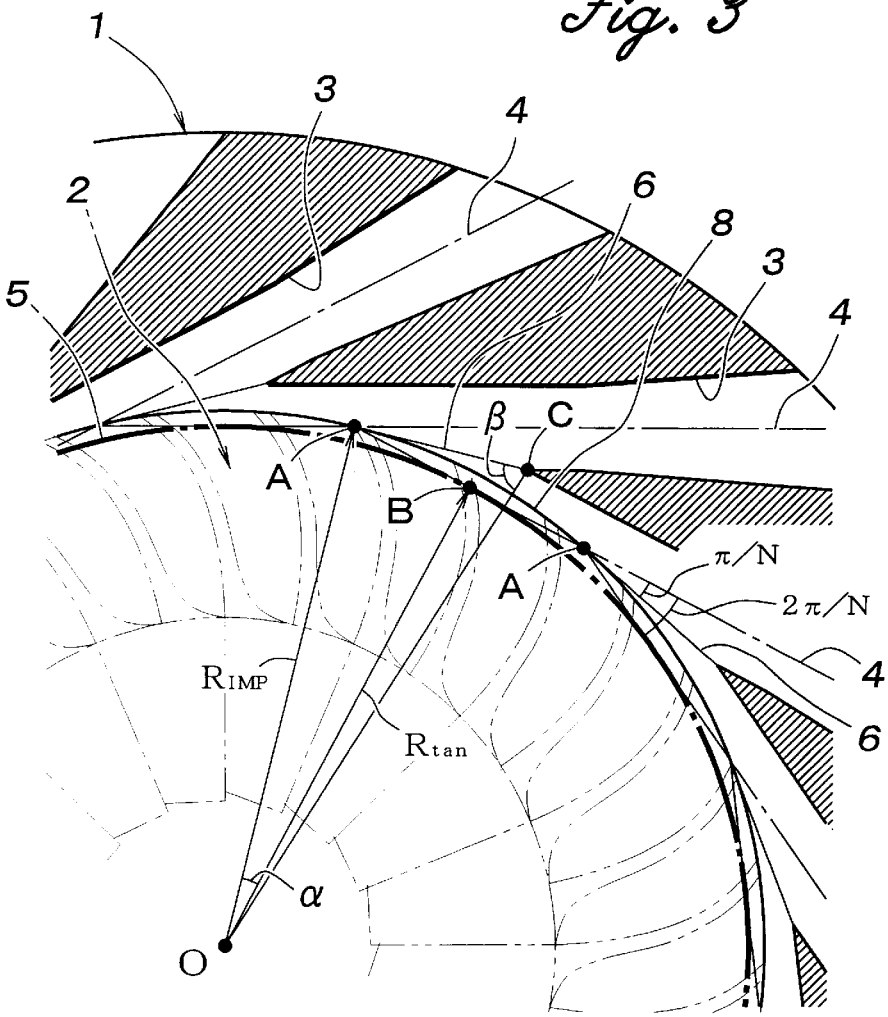
FIG. 3 is an enlarged sectional front view of the diffuser.

As shown in FIG. 3, the leading edge 6 extends between the intersection A of the longitudinal center lines 4 of the adjacent passages 3 as seen in FIG. 3 (as projected on a plane parallel to the paper sheet of FIG. 3) and the most recessed central part of the wall C between the adjacent passages 3. The leading edge angle β or the angle of the leading edge 6 with respect to the radial line OC passing through the leading edge central point C and the center O of the impeller 2 (as seen in FIG. 3) varies depending on the diameter of the reference tangent circle 5.

If the total number of passages 3 is N, the longitudinal center lines 4 of the adjacent passages 3 intersect each other at the angle of 2π/N. The leading edge 6 as seen in FIG. 3 or the tangential line of the outer peripheral circle 8 of the impeller 2 at the intersection A as seen in FIG. 3 intersects the longitudinal central line 4 of the corresponding passage 3 or the tangential line at the tangential point B of the reference tangent circle 5 at the angle of π/N.

If the radius of the impeller 2 is $R_{IMP}$ and the angle formed between the radial lines OA and OB is α, the radius of the reference tangent circle $R_{tan}$ to which the center line 4 of the passage 3 is tangential can be given by the following relationship.

$$R_{tan}=R_{IMP}\times\cos\alpha$$

Because the angle α=π/N, the radius of the reference tangent circle can be given by the following relationship.

$$R_{tan}=R_{IMP}\times\cos(\pi/N)$$

Figure 4:
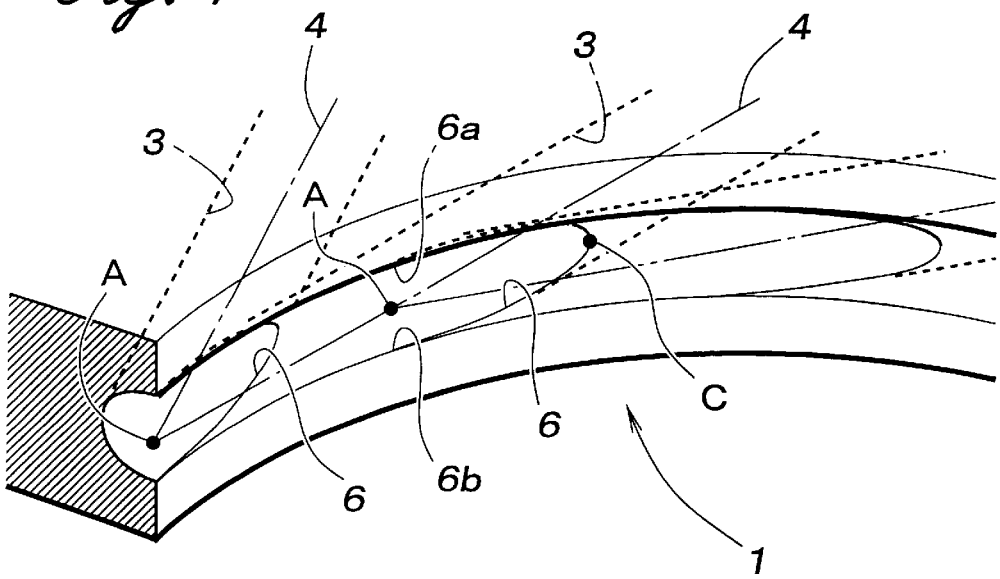
FIG. 4 is a fragmentary perspective view of the diffuser showing the inner peripheral part thereof.

The line defining the leading edge 6 as seen in the front view is tangential to the outer circumferential circle of the impeller 2. However, in reality, a certain gap should be provided between the impeller 2 and the leading edge 6. Then, the radius $R_{tan}$ of the reference tangent circle 5 can be given by the following relationship.

$$R_{tan}=R_{IMP}\times\cos(\pi/N)+\delta$$

where δ is a small value corresponding to the gap. δ should be as small as possible provided that there is no interference between the impeller and diffuser. However, for practical purposes, δ should be in the range of 0.1 to 0.2% of the impeller radius $R_{IMP}$. If the inner circumferential surface of the diffuser 1 passes through the intersection A of the center lines of each pair of adjacent passages, the side ends 6*a* and 6*b* of the leading edge 6 are located on the inner circumferential surface of the diffuser 1 as shown in FIG. 4. Therefore, when drilling the passages 3, no protrusions 30 such as those shown in FIG. 9 are produced, and this simplifies the machining process for the diffuser.

The inner peripheral surface of the diffuser 1 is dimensioned so as to be slightly larger than the outer peripheral circle 8 of the impeller 2, but, still, no such protrusions 30 would be produced.

Figure 5:
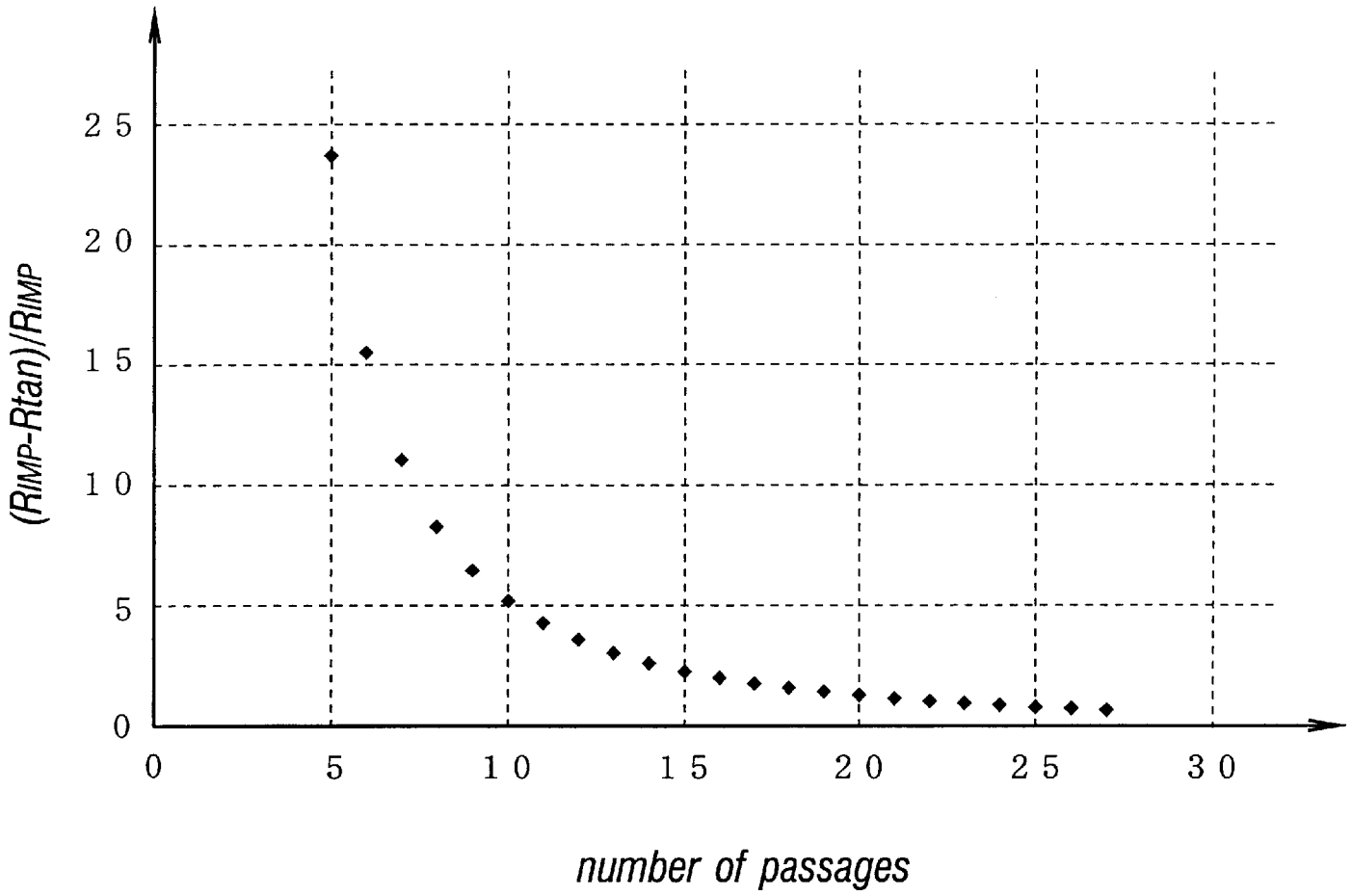
FIG. 5 is a graph showing the relationship between the number of passages and the desirable size of the reference tangent circle.

In the illustrated embodiment, there are 13 passages. How much smaller the reference tangent circle 5 should be in relation to the outer peripheral circle 8 of the impeller 2 depends on the number of passages. More specifically, the ratio of the difference between the radius of the impeller 2 and the radius of the reference tangent circle 5 to the radius of the impeller 2 diminishes with the increase in the number of passages as shown in the graph of FIG. 5. If the number of passages is greater than 22, the ratio is less than 1%, and the difference between the reference circle 5 and the outer peripheral circle 8 of the impeller 2 is no more than the required clearance between the impeller and diffuser, and any appreciable gain cannot be achieved.

Figure 6:
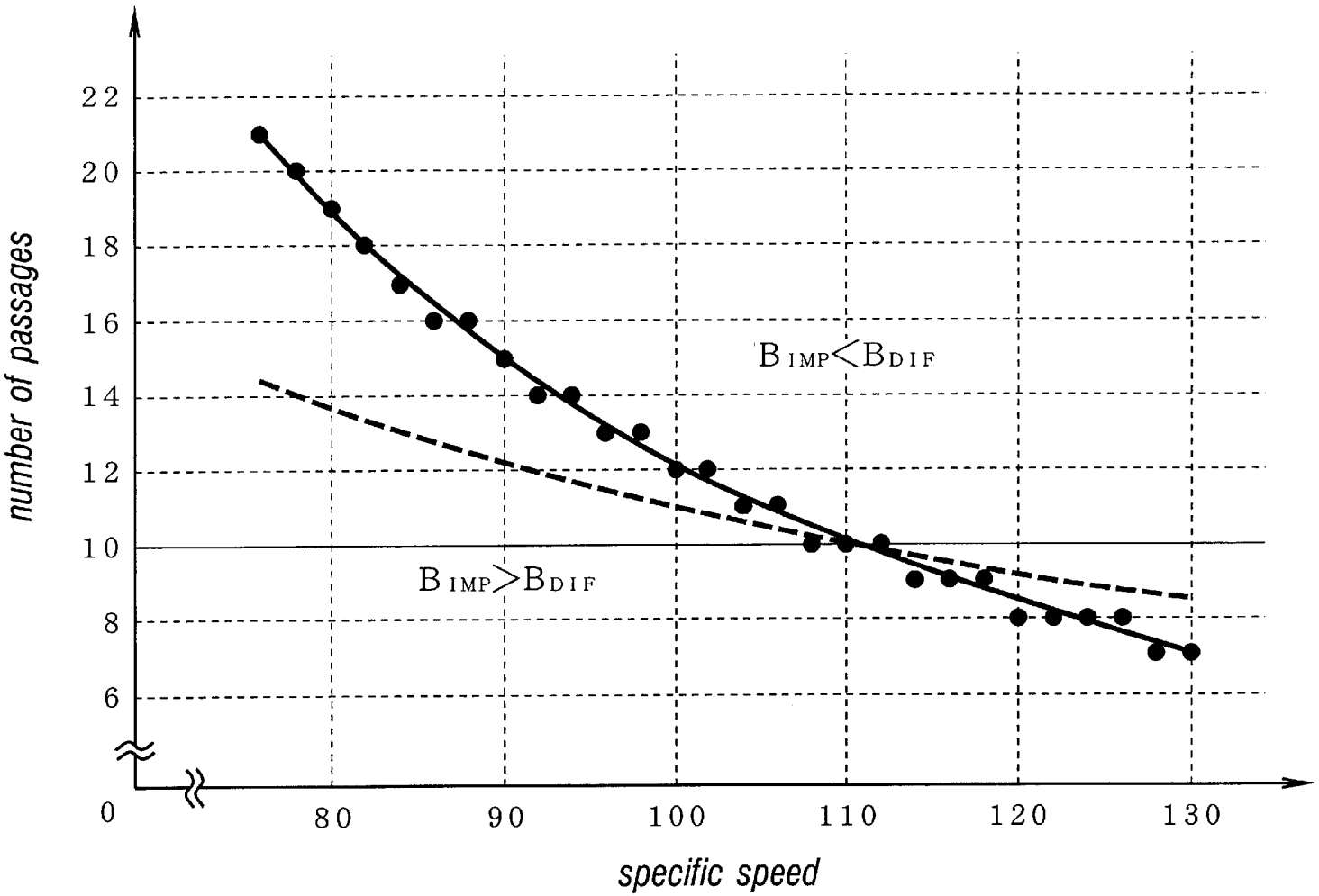
FIG. 6 is a graph showing the relationship between the number of passages and the specific speed.

When the diameter of the compressor is reduced and the specific speed is thereby increased, the number of passages that optimizes the performance decreases as shown in the solid line in FIG. 6. If the number of passages is less than 10, the inlet width $B_{DIF}$ of the diffuser 1 becomes smaller than the outlet width $B_{IMP}$ of the impeller 2, and the resulting mismatch prevents a desired performance to be achieved. The dotted line curve in FIG. 6 shows a line at which the inlet width $B_{DIF}$ of the diffuser 1 and the outlet width $D_{IMP}$ of the impeller 2 agree with each other. $B_{INP}>B_{DIF}$ holds in the region under this line. In the graph of FIG. 6, the degree of reaction is assumed to be constant (=0.66).

Figure 7:
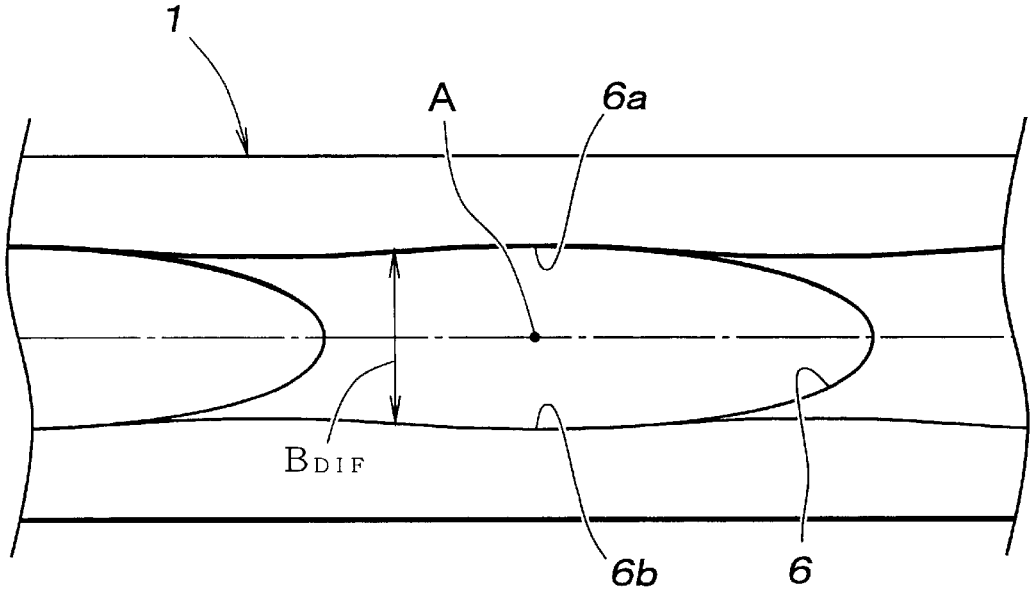
FIG. 7 is an enlarged end view of an inner peripheral part of the diffuser.

More specifically, as shown in FIG. 7, the open end of the diffuser 1 along the inner periphery thereof is provided with a wavy shape as a result of drilling the passages 3, and the inlet width $B_{DIF}$ is maximized at the intersection A at which the longitudinal center lines 4 of the adjacent passages 3 intersect, and is made to agree with the diameter of the passage 3. If the number of passages is small, the amplitude of the wavy shape increases. This may cause the inlet width $B_{DIF}$ of the diffuser 1 to get smaller than the outlet width DIMP of the impeller 2, and this creates a mismatch between the diffuser inlet and the impeller outlet.

Thus, according to the present invention, because the leading edge, in particular the side portions thereof, is brought close to the outer peripheral part of the impeller, the incidence mismatch can be minimized so that a blockage in the throat section of each passage can be avoided, and the static pressure can be recovered at a high efficiency. Also, when drilling the passages, protrusions are not formed in the inner peripheral part of the diffuser. Elimination of the need to remove such protrusions contributes to the reduction in the manufacturing cost.

Although the present invention has been described in terms of a preferred embodiment thereof, it is obvious to a person skilled in the art that various alterations and modifications are possible without departing from the scope of the present invention which is set forth in the appended claims.

What is claimed is:

1. A diffuser arrangement for a centrifugal compressor, comprising a member surrounding an impeller of the compressor and defining a plurality of passages extending substantially tangentially around said impeller at a regular interval circumferentially, wherein:

a longitudinal center line of each of said passages is tangential to a reference tangent circle defined concentrically with respect to said impeller and having a smaller diameter than an outer diameter of said impeller so that a leading edge defined at an intersection between each pair of adjacent passages is brought close to an outer periphery of said impeller.

2. A diffuser arrangement for a centrifugal compressor according to claim 1, wherein the radius of the reference tangent circle or $R_{tan}$ is given by $$R_{tan}=R_{IMP}\times\cos(\pi/N)+\delta$$

where $R_{IMP}$ is the radius of the impeller, N is the number of passages, and δ is a small gap for providing a clearance between the impeller and diffuser.

3. A diffuser arrangement for a centrifugal compressor according to claim 2, wherein the number of passages is between 10 and 22.

4. A diffuser arrangement for a centrifugal compressor according to claim 1, wherein said passages consist of holes drilled in the member disposed concentrically with respect to the impeller.

5. A diffuser arrangement for a centrifugal compressor according to claim 4, wherein each of said passages is flared outwardly at least in a radially outer part thereof.

* * * * *